US007758119B1

(12) United States Patent
Baterdouk

(10) Patent No.: US 7,758,119 B1
(45) Date of Patent: Jul. 20, 2010

(54) AUXILIARY SOFA BACKREST SYSTEM

(76) Inventor: Muhammed N. Baterdouk, 30B Hazen Ct., Wayne, NJ (US) 07470

( * ) Notice: Subject to any disclaimer, the term of this patent is extended or adjusted under 35 U.S.C. 154(b) by 153 days.

(21) Appl. No.: 12/120,524

(22) Filed: May 14, 2008

(51) Int. Cl.
*A47C 7/42* (2006.01)

(52) U.S. Cl. ..... 297/230.1; 297/230.12; 297/284.5; 297/217.6

(58) Field of Classification Search ..... 297/217.6, 297/230.1, 232, 233, 239, 284.5, 397, 230.12, 297/230.13
See application file for complete search history.

(56) References Cited

U.S. PATENT DOCUMENTS

| | | | | |
|---|---|---|---|---|
| 2,734,556 | A * | 2/1956 | Hebrank | 297/230.1 X |
| 3,145,054 | A | 8/1964 | Sopko, Jr. | |
| 3,361,471 | A | 1/1968 | Radford | |
| 4,189,182 | A | 2/1980 | Rhoe | |
| 4,535,495 | A | 8/1985 | Oldfield | |
| 4,572,578 | A | 2/1986 | Perkins | |
| 4,718,727 | A | 1/1988 | Sheppard | |
| 4,848,839 | A * | 7/1989 | Galardo | 297/440.1 X |
| D325,683 | S | 4/1992 | Meyer et al. | |
| 5,314,235 | A | 5/1994 | Johnson | |
| 5,452,940 | A | 9/1995 | Maier | |
| 5,503,457 | A * | 4/1996 | Rosado | 297/217.6 X |

* cited by examiner

*Primary Examiner*—Anthony D Barfield

(57) ABSTRACT

A auxiliary sofa backrest system includes a sofa with a seat and a backrest that is attached to and extends upwardly from the seat. The seat includes a pair of laterally positioned armrests. A plurality of seat cushions is positioned on the seat. A bottom panel has a rear edge. A vertical panel has a bottom edge, a top edge, a first lateral edge, a second lateral edge, a front side and a back side. The bottom edge is hingedly coupled to the rear edge. The bottom panel is removably positioned under one of the seat cushions and the back side of the vertical panel abuts one of the armrests.

8 Claims, 5 Drawing Sheets

AUXILIARY SOFA BACKREST SYSTEM

BACKGROUND OF THE INVENTION

Field of the Invention

The present invention relates to backrest devices and more particularly pertains to a new backrest device for fully supporting a person's back when that person is sitting lateral of a primary backrest of a sofa.

SUMMARY OF THE INVENTION

The present invention meets the needs presented above by generally comprising a sofa that includes a seat and a backrest that is attached to and extends upwardly from the seat. The seat includes a pair of laterally positioned armrests. A plurality of seat cushions is positioned on the seat. A bottom panel has a rear edge. A vertical panel has a bottom edge, a top edge, a first lateral edge, a second lateral edge, a front side and a back side. The bottom edge is hingedly coupled to the rear edge. The bottom panel is removably positioned under one of the seat cushions and the back side of the vertical panel abuts one of the armrests.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
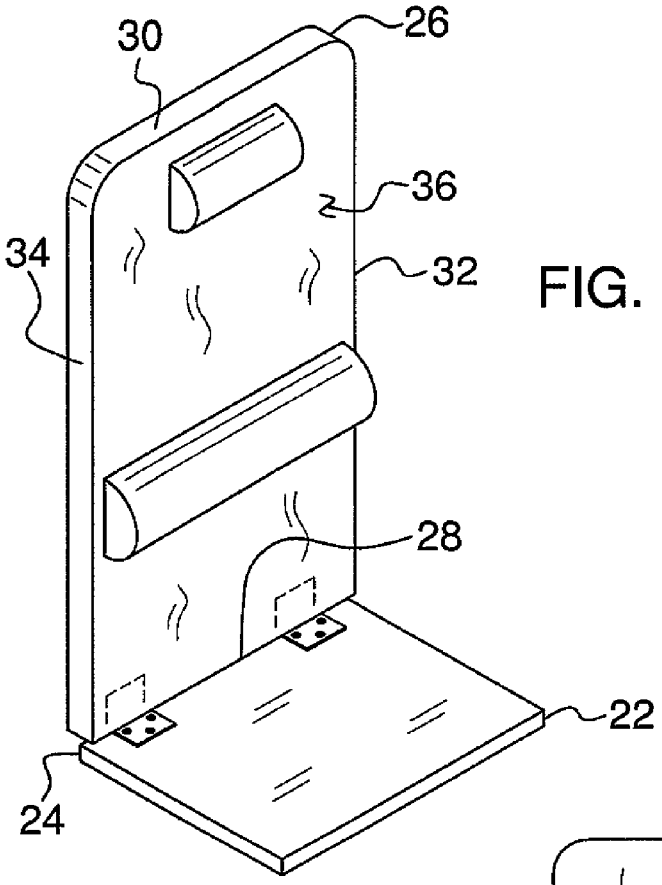
FIG. 1 is a front perspective view of a auxiliary sofa backrest system according to the present invention.
Figure 2:
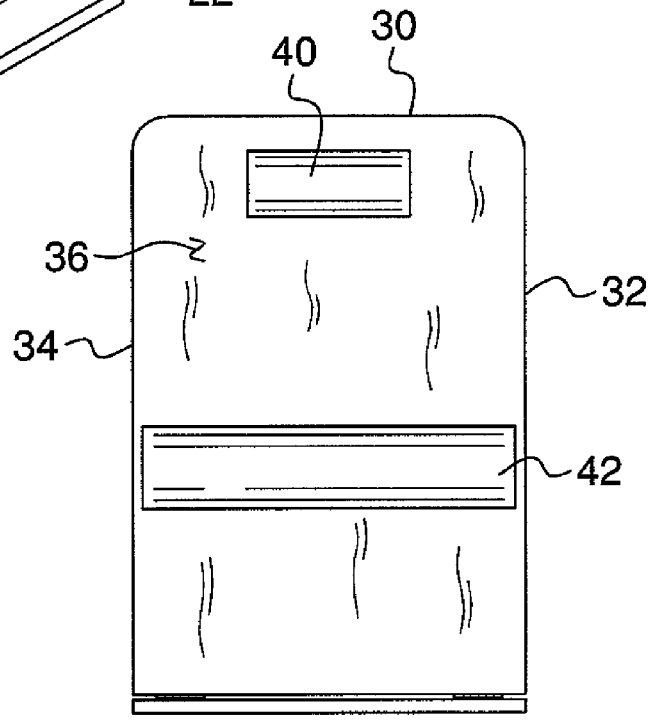
FIG. 2 is a front view of the present invention.
Figure 3:
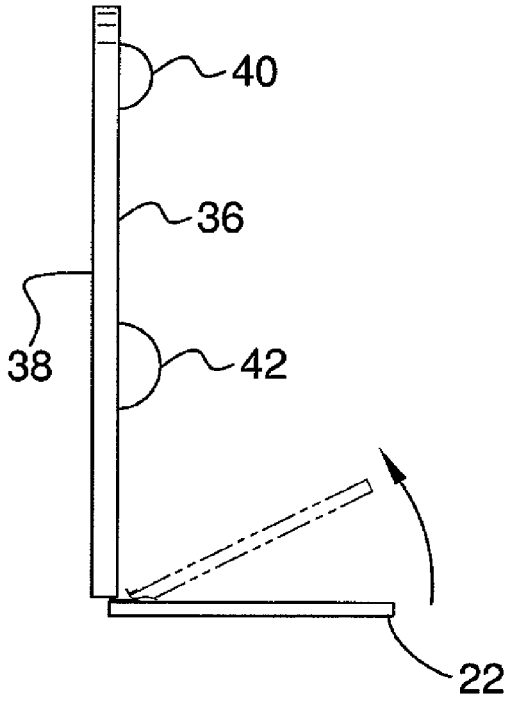
FIG. 3 is a side view of the present invention.
Figure 4:
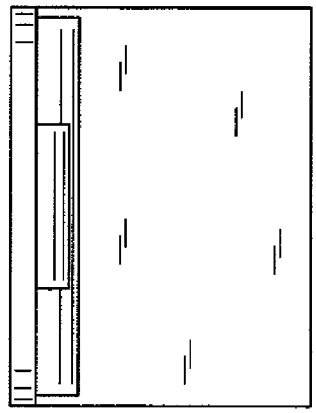
FIG. 4 is a top view of the present invention.
Figure 5:
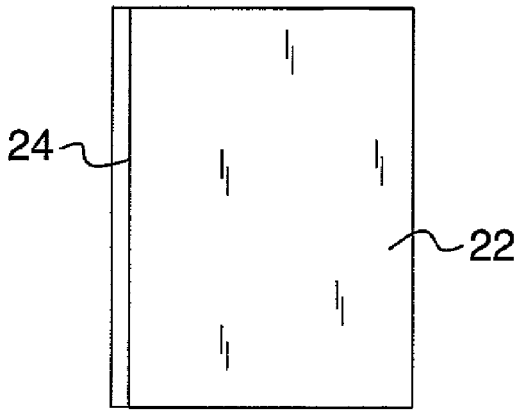
FIG. 5 is a bottom view of the present invention.

With reference now to the drawings, and in particular to FIGS. 1 through 10 thereof, a new backrest device embodying the principles and concepts of the present invention and generally designated by the reference numeral 10 will be described.

As best illustrated in FIGS. 1 through 10, the auxiliary sofa backrest system 10 generally comprises a conventional sofa 12 that includes a seat 14 and a backrest 16 that is attached to and extends upwardly from the seat 14. The seat 14 includes a pair of laterally positioned armrests 18. A plurality of seat cushions 20 is positioned on the seat 14.

A bottom panel 22 is provided that has a rear edge 24. A vertical panel 26 has a bottom edge 28, a top edge 30, a first lateral edge 32, a second lateral edge 34, a front side 36 and a back side 38. The bottom edge 28 is hingedly coupled to the rear edge 24. The bottom panel 22 is removably positioned under one of the seat cushions 20 and the back side 38 of the vertical panel 26 abuts one of the armrests 18. When a person sits on the cushion 20 under which the bottom panel 22 is position, the vertical panel 26 may be used as a full sized backrest.

A headrest 40 is attached to the front side 36 adjacent to the top edge 30. The headrest 40 is comprised of a resiliently compressible material. A back support 42, for supporting the lumbar portion of a person's back, is attached to the front side 36 and extends between the first 32 and second 34 lateral edges. The back support 42 is positioned nearer to the bottom edge 28 than the top edge 30 and is also comprised of a resiliently compressible material.

An arm 44 is pivotally coupled to the back side 38 of the vertical panel 26. The arm 44 includes a first section 46, a second section 48 and a third section 50. The first 46 and second 48 sections are oriented parallel to each other and the third section 50 extends between the first 46 and second 48 sections. The first section 48 is pivotally coupled to the back side 38 and is extendable outwardly from or retracted toward the first lateral edge 32. The second section 48 is positionable in a stored position abutting the back side 38 or in a deployed position forward of the front side 36. The third section 50 includes a first portion 52 and a second portion 54 rotatably coupled to each other. A tray 56 is attached to the arm 44 and is positioned on the second section 48. A locking member 58 is positioned on the back side 36 and releasably secures the tray 56 to the back side.

A light emitter 60 is attached to the vertical panel 26 adjacent to the top edge 30. The light emitter 60 is positioned to emit light downwardly in front of the front side 36 of the vertical panel 26 when the light emitter 60 is turned on.

Figure 6:
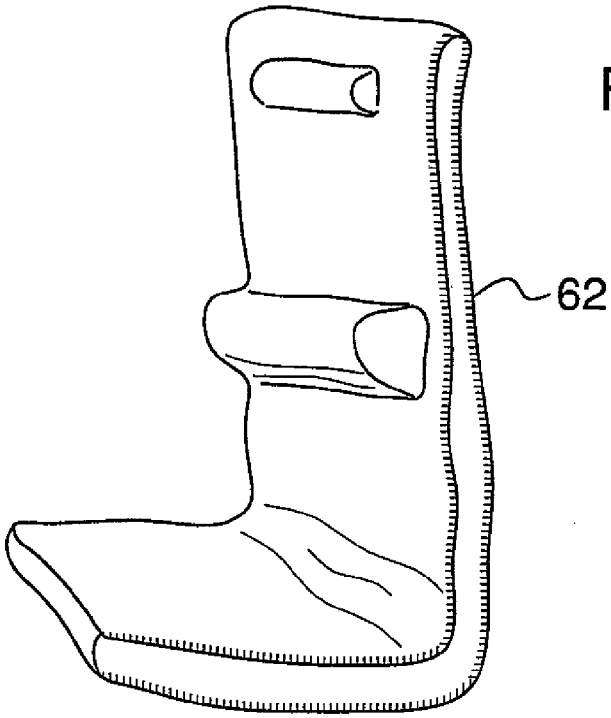
FIG. 6 is a perspective view of a cover of the present invention.
Figure 7:
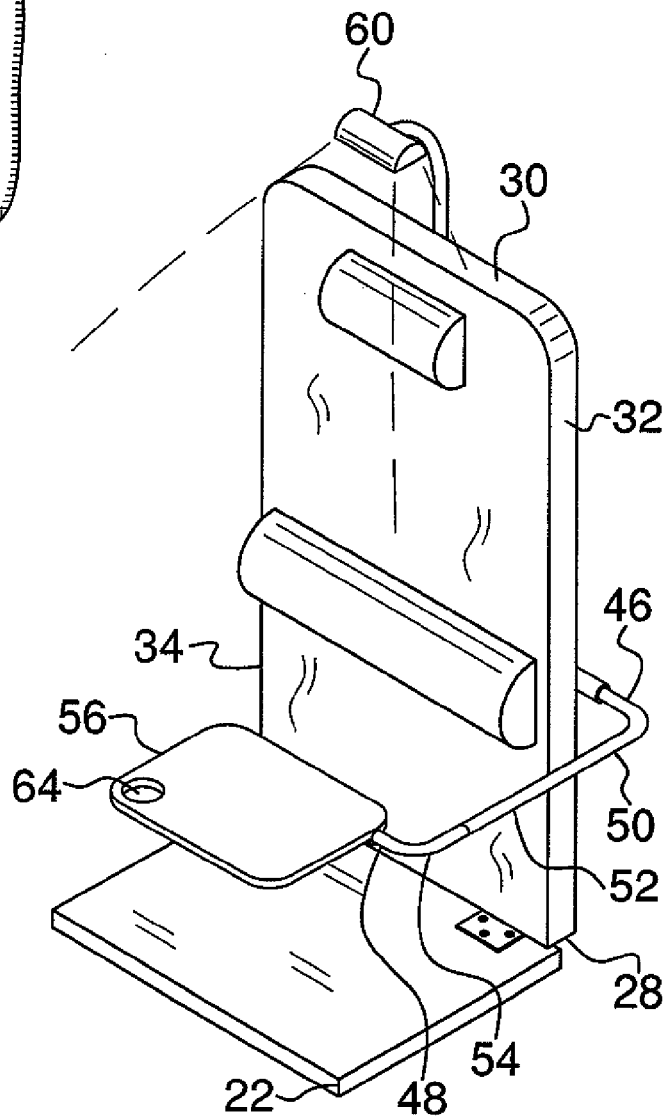
FIG. 7 is a front view of the present invention of an embodiment.
Figure 8:
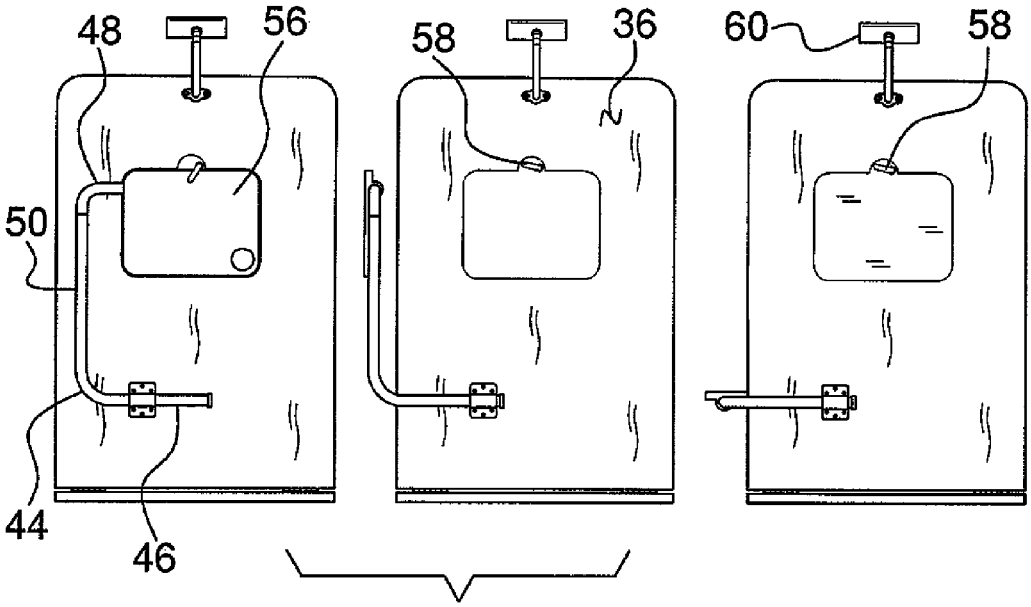
FIG. 8 is a rear view of the embodiment of the present invention shown in FIG. 7 having an positioned in multiple locations.
Figure 9:
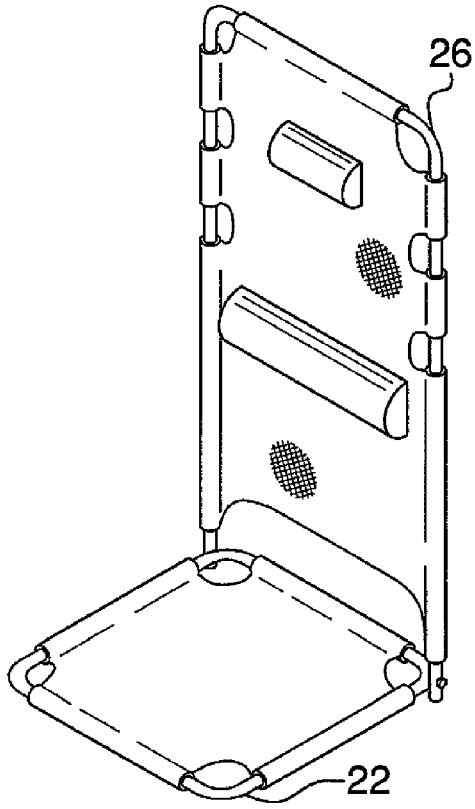
FIG. 9 is a front perspective view of an embodiment of the present invention.
Figure 10:
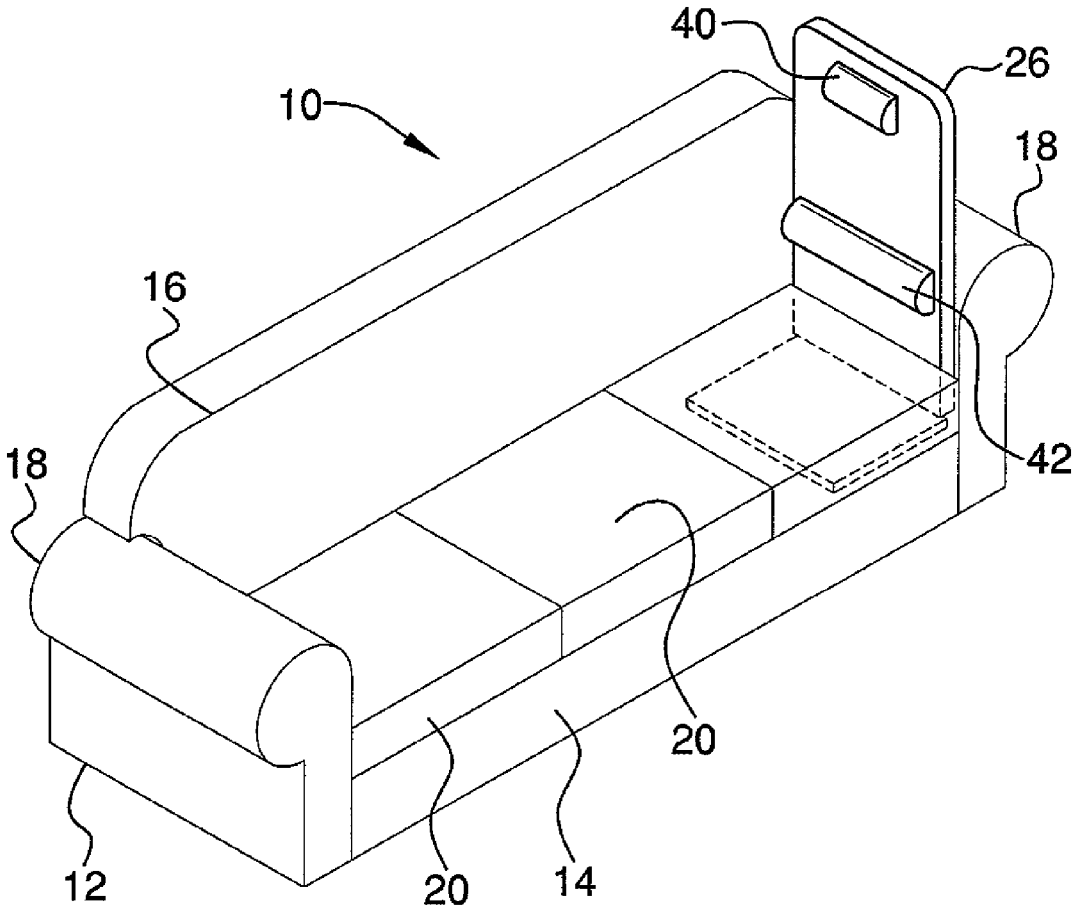
FIG. 10 is a front perspective in-use view of the present invention.

Another embodiment of the system 10 is shown in FIG. 9 wherein the bottom 22 and vertical 26 panels are comprised of a mesh material mounted on a tubular frame. FIG. 6 shows a cover 62 which may be removably positioned over the bottom 22 and vertical panels 26.

In use, the bottom panel 22 is placed under a seat cushion 20 as described above and shown in the Figures so that the vertical panel 26 provides a backrest for a person sitting on the sofa while their legs extends between the armrests 18. If a table is needed, the tray 56 is used to support items in front of the person. The tray 56 may have an aperture 64 extending therethrough to receive a drink cup or glass.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An auxiliary sofa backrest system comprising:

a sofa including a seat and a backrest being attached to and extending upwardly from said seat, said seat including a pair of laterally positioned armrests, a plurality of seat cushions being positioned on said seat;

a bottom panel having a rear edge; and a vertical panel having a bottom edge, a top edge, a first lateral edge, a second lateral edge, a front side and a back side, said bottom edge being hingedly coupled to said rear edge, said bottom panel being removably positioned under one of said seat cushions and said back side of said vertical panel abutting one of said armrests; and an arm being pivotally coupled to said back side of said vertical panel; and a tray being attached to said arm.

2. The system according to claim 1, further including a headrest being attached to said front side adjacent to said top edge.

3. The system according to claim 2, further including a back support being attached to said front side and extending between said first and second lateral edges, said back support being positioned nearer to said bottom edge than said top edge.

4. The system according to claim 1, further including a back support being attached to said front side and extending between said first and second lateral edges.

5. The system according to claim 1, wherein said arm includes a first section, a second section and a third section, said first and second sections being oriented parallel to each other and said third section extending between said first and second sections, said first section being pivotally coupled to said back side and being extendable outwardly from or retracted toward said first lateral edge, said second section being positionable in a stored position abutting said back side or in a deployed position forward of said front side, said arm being positioned on said second section.

6. The system according to claim 1, further including a locking member being positioned on said back side and releasably securing said tray to said back side.

7. The system according to claim 1, further including a light emitter being attached to said vertical panel adjacent to said top edge.

8. An auxiliary sofa backrest system comprising:

a sofa including a seat and a backrest being attached to and extending upwardly from said seat, said seat including a pair of laterally positioned armrests, a plurality of seat cushions being positioned on said seat;

a bottom panel having a rear edge;

a vertical panel having a bottom edge, a top edge, a first lateral edge, a second lateral edge, a front side and a back side, said bottom edge being hingedly coupled to said rear edge, said bottom panel being removably positioned under one of said seat cushions and said back side of said vertical panel abutting one of said armrests;

a headrest being attached to said front side adjacent to said top edge, said headrest being comprised of a resiliently compressible material;

a back support being attached to said front side and extending between said first and second lateral edges, said back support being positioned nearer to said bottom edge than said top edge;

an arm being pivotally coupled to said back side of said vertical panel, said arm including a first section, a second section and a third section, said first and second sections being oriented parallel to each other and said third section extending between said first and second sections, said first section being pivotally coupled to said back side and being extendable outwardly from or retracted toward said first lateral edge, said second section being positionable in a stored position abutting said back side or in a deployed position forward of said front side, said third section including a first portion and a second portion rotatably coupled to each other;

a tray being attached to said arm, said arm being positioned on said second section;

a locking member being positioned on said back side and releasably securing said tray to said back side; and a light emitter being attached to said vertical panel adjacent to said top edge.

* * * * *